US012096835B2

(12) United States Patent
Van Der Scheer et al.

(10) Patent No.: US 12,096,835 B2
(45) Date of Patent: Sep. 24, 2024

(54) EPILATING DEVICE

(71) Applicant: KONINKLIJKE PHILIPS N.V., Eindhoven (NL)

(72) Inventors: Robbert Freerk Johan Van Der Scheer, Groningen (NL); Joost Tomas Glazenburg, Groningen (NL); Geert Willem De Goeij, Drachten (NL); Adarsh Shrivastava, Groningen (NL); Johannes Beugels, Peize (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 358 days.

(21) Appl. No.: 17/762,107

(22) PCT Filed: Oct. 1, 2020

(86) PCT No.: PCT/EP2020/077541
§ 371 (c)(1),
(2) Date: Mar. 21, 2022

(87) PCT Pub. No.: WO2021/064111
PCT Pub. Date: Apr. 8, 2021

(65) Prior Publication Data

US 2022/0346520 A1 Nov. 3, 2022

(30) Foreign Application Priority Data

Oct. 1, 2019 (EP) ..... 19200837

(51) Int. Cl.
*A45D 26/00* (2006.01)

(52) U.S. Cl.
CPC ..... *A45D 26/0028* (2013.01)

(58) Field of Classification Search
CPC ..... A45D 26/00; A45D 26/0023; A45D 26/0028; A45D 26/0038
(Continued)

(56) References Cited

U.S. PATENT DOCUMENTS 4,960,422 A 10/1990 Demeester
5,281,233 A 1/1994 Dolev
(Continued)

FOREIGN PATENT DOCUMENTS

DE 19602559 A1 3/1997
EP 2719299 A2 4/2014
(Continued)

OTHER PUBLICATIONS

International Search Report and Written Opinion Dated Nov. 4, 2020 for International Application No. PCT/EP2020/077451 Filed Oct. 1, 2020.

*Primary Examiner* — Kankindi Rwego

(57) ABSTRACT

An epilating device for extracting hairs out of a user's skin, including hair-clamping elements that are arranged adjacent to each other and rotatable relative to a housing. A drive system rotates the hair-clamping elements which co-operate in pairs and are moveable relative to each other during rotation. On each side surface facing an adjacent hair-clamping element, there is a hair-clamping section and a hair-catching section. The hair-catching sections of adjacent hair-clamping elements define a funnel area, wherein the hair-catching sections converge towards each other for guiding hairs towards the hair-clamping sections. The hair-clamping sections of adjacent hair-clamping elements are movable relative to each other from an open position, where the hair-clamping sections are at a distance from each other, to a closed position, where the hair-clamping sections are in mutual clamping engagement in a hair-clamping area.

9 Claims, 4 Drawing Sheets

(58) Field of Classification Search
USPC ..... 606/133
See application file for complete search history.

(56) References Cited

U.S. PATENT DOCUMENTS

| | | | |
|---|---|---|---|
| 5,976,157 | A | 11/1999 | Yiu |
| 8,608,756 | B2 | 12/2013 | Oberman |
| 9,888,757 | B2 | 2/2018 | Grieshaber |
| 2012/0165833 | A1 | 6/2012 | Huisinga |
| 2012/0165835 | A1 | 6/2012 | Huisinga |

FOREIGN PATENT DOCUMENTS

| | | | |
|---|---|---|---|
| EP | 2719300 | A2 | 4/2014 |
| EP | 1703821 | B1 | 8/2016 |
| JP | 10215945 | A | 8/1998 |
| JP | 2010069240 | A | 4/2010 |
| WO | 2012/131416 | A1 | 10/2012 |

EPILATING DEVICE

CROSS REFERENCE TO RELATED APPLICATIONS

This application is the U.S. National Phase application under 35 U.S.C. § 371 of International Application No. PCT/EP2020/077541 filed Oct. 1, 2020, which claims the benefit of European Patent Application Number 19200837.3 filed Oct. 1, 2019. These applications are hereby incorporated by reference herein.

FIELD OF THE INVENTION

The present invention relates to an epilating device for extracting hairs out of a user's skin. More particular, the present invention relates to an epilating device comprising:

- a housing;
- an epilating system comprising a plurality of hair-clamping elements arranged adjacent to each other and rotatable relative to the housing about an axis of rotation; and
- a drive system arranged to rotate the hair-clamping elements in a rotational direction about the axis of rotation;
- wherein the hair-clamping elements are arranged to cooperate in pairs and are moveable relative to each other by means of an actuation mechanism during rotation of the epilating system;
- wherein each hair-clamping element comprises, on each side surface facing an adjacent hair-clamping element, at least one hair-clamping section and at least one hair-catching section preceding the hair-clamping section in the rotational direction;
- wherein the hair-catching sections of a pair of adjacent hair-clamping elements define a funnel area, wherein the hair-catching sections converge towards each other for guiding hairs towards the hair-clamping sections of the pair of adjacent hair-clamping elements;
- wherein the hair-clamping sections of a pair of adjacent hair-clamping elements are movable relative to each other from an open position, wherein the hair-clamping sections of the pair of adjacent hair-clamping elements are at a distance from each other, to a closed position, wherein the hair-clamping sections of the pair of adjacent hair-clamping elements are in mutual clamping engagement in a hair-clamping area;
- wherein, seen relative to the axis of rotation, the funnel area extends in a tangential direction between a first radial line and a second radial line, and wherein a funnel angle of the funnel area is defined as the angle enclosed by the first and second radial lines; and
- wherein, seen relative to the axis of rotation, the hair-clamping area extends in a tangential direction between the second radial line and a third radial line, and wherein a clamping angle of the hair-clamping area is defined as the angle enclosed by the second and third radial lines.

Such an epilating device is known from U.S. Pat. No. 4,960,422 A.

BACKGROUND OF THE INVENTION

The known epilating device mentioned above comprises a rotary epilating roller formed by a series of blades placed side by side. The blades of the roller are movably mounted on a driving shaft so as to be capable of pivoting about an axis perpendicular to the shaft. The blades are actuated by means of sliding bars which are capable of producing a pivotal displacement of the blades at least once per revolution of the roller so that one blade pivots in one direction, the following blade pivots in the opposite direction, and each blade pivots about a separate and distinct axis perpendicular to the driving shaft. Two adjacent blades are thus clamped against each other opposite to the work surface, the hairs being pinched between the two blades in order to be extracted.

The known epilating device mentioned above is still subject for improvement. In particular, the efficiency of catching and extracting hairs needs to be improved.

Another epilating device known from EP 2 719 300 A2 comprises a clamping unit for clamping and extracting hairs out of a user's skin. The clamping unit is configured to be driven relative to a housing along a hair capture direction, the clamping unit having a first and a second clamping element, the first clamping element including a clamping surface and a hair guiding surface, wherein the first clamping element and the second clamping element are arranged to be cyclically moved between an open position, in which the two clamping surfaces have minimal distance such that a gap for receiving hairs is formed between them, and a closed position, in which the two clamping surfaces abut on each other, so as to form a hair-clamping area, wherein the two hair guiding surfaces form a funnel area in front of the gap in the open position with respect to the hair capture direction. A length extension of the clamping section or the hair-clamping area in the tangential or peripheral direction defines a clamping angle ($\alpha_c$), a length extension of the funnel area in the tangential or peripheral direction defines a funnel angle ($\alpha_f$). A ratio ($\beta$) being defined as the ratio ($\alpha_c/\alpha_f$) between the clamping angle ($\alpha_c$) and the funnel angle ($\alpha_f$), is in a range from 1.05 to 1.6.

This shall define a good balance between the circumferential extension used on the hair-clamping cylinder for the actual hair-clamping section relative to the extension around the perimeter of the clamping cylinder used for the hair-guiding surfaces provided on the winged sections. The range from 1.05 to 1.6 shall provide for an improved operating performance, since an optimum compromise between a sufficient funnel angle and a sufficient clamping angle shall be reached.

However, the operating performance of the epilating device still needs to be further improved. In particular, the hair-catching and extracting efficiency needs to be improved.

Further reference is made to EP 2 719 299 A2, and to U.S. Pat. No. 9,888,757 B2 which disclose similar epilating devices.

In addition an epilating device according to the preamble of claim 1 has become known by public use, since it has been sold by the applicant. In this epilating device the ratio ($\beta$) between the clamping angle ($\alpha_c$) and the funnel angle ($\alpha_f$) is 0.68. Also with this epilating device, the operating performance still needs to be improved. In particular, the hair-catching and extracting efficiency (also called hair catching and clamping efficacy) needs to be improved.

SUMMARY OF THE INVENTION

In view of this it is an object of the invention to disclose an epilating device having an improved hair catching and clamping efficacy.

This object is solved with an epilating device according to claim 1.

According to the invention it was found that a design, wherein the ratio $\beta=\alpha_c/\alpha_f$ between the clamping angle $\alpha_c$ and the funnel angle $\alpha_f$ is in a range from 1.65 to 8.75, and where each hair-clamping element comprises at least one recessed area which precedes the hair-catching section in the rotational direction and is recessed relative to the hair-clamping section and the hair-catching section in a radial direction relative to the axis of rotation; wherein seen relative to the axis of rotation, the recessed area extends in a tangential direction between the first radial line and a fourth radial line, wherein a recess angle of the recessed area is defined as the angle enclosed by the first and fourth radial lines; and wherein a ratio $\gamma=\alpha_c/(\alpha_f+\alpha_r)$ is defined as the ratio between the clamping angle $\alpha_c$ and the sum of the funnel angle $\alpha_f$ and the recess angle $\alpha_r$ is in a range from 1.26 to 3.5 leads to an improved hair catching and clamping efficacy.

Preferred embodiments of the invention are defined in the dependent claims.

According to another embodiment of the invention, the ratio $\beta$ is at least 1.75.

According to another embodiment of the invention, the ratio $\beta$ is not larger than 8.

According to another embodiment of the invention, the ratio $\beta$ is not larger than 7.

It was found that using such a ratio $\beta$ further improves the catching and clamping efficiency of the epilating device.

According to another embodiment of the invention, the actuation mechanism comprises a compression member arranged to exert a compression force on the epilating system along at least a compression line which extends parallel to a main direction of extension of the axis of rotation, wherein the hair-clamping elements are tiltable relative to each other under the influence of the compression force during rotation of the epilating system.

Such a design uses the advantageous embodiment of an actuation mechanism, wherein the mere rotation of the hair-clamping elements that are arranged in pairs about the axis of rotation provides for the movement of the pairs of hair-clamping elements between the open and the closed positions.

According to another embodiment of the invention, the hair-clamping elements are each configured in disk-shape and each comprise two pairs of a hair-clamping area and a preceding funnel area on each side surface facing an adjacent hair-clamping element.

This provides an effective design of an epilating device.

According to another embodiment of the invention, each hair-clamping element, which is arranged between two adjacent hair-clamping elements, comprises a first and a second set of a hair-clamping area and a preceding funnel area arranged in diametrically opposite positions on a first side surface facing one of the two adjacent hair-clamping elements, and a third and a fourth set of a hair-clamping area and a preceding funnel area arranged in diametrically opposite positions on a second side surface facing the other one of the two adjacent hair-clamping elements, wherein the first and second sets are arranged relative to the third and fourth set with angular intervals of 90° relative to the axis of rotation.

According to another embodiment of the invention, the pairs of adjacent hair-clamping elements each comprise torque-transmitting elements engaging each other for transmitting torque between the adjacent hair-clamping elements.

According to a further embodiment of the invention, the hair-clamping elements are rotationally supported by a curved supporting shaft mounted in a stationary position relative to the housing, wherein the hair-clamping elements each comprise a receiving opening arranged centrally on the hair-clamping element for receiving the supporting shaft.

These embodiments all serve to improve the overall design of the epilating device, leading to a very compact, reliable, and effective device.

BRIEF DESCRIPTION OF THE DRAWINGS

These and other aspects of the invention will be apparent from and elucidated with respect to the embodiment described hereinafter. In the following drawings.

DETAILED DESCRIPTION OF THE EMBODIMENTS

Figure 1:
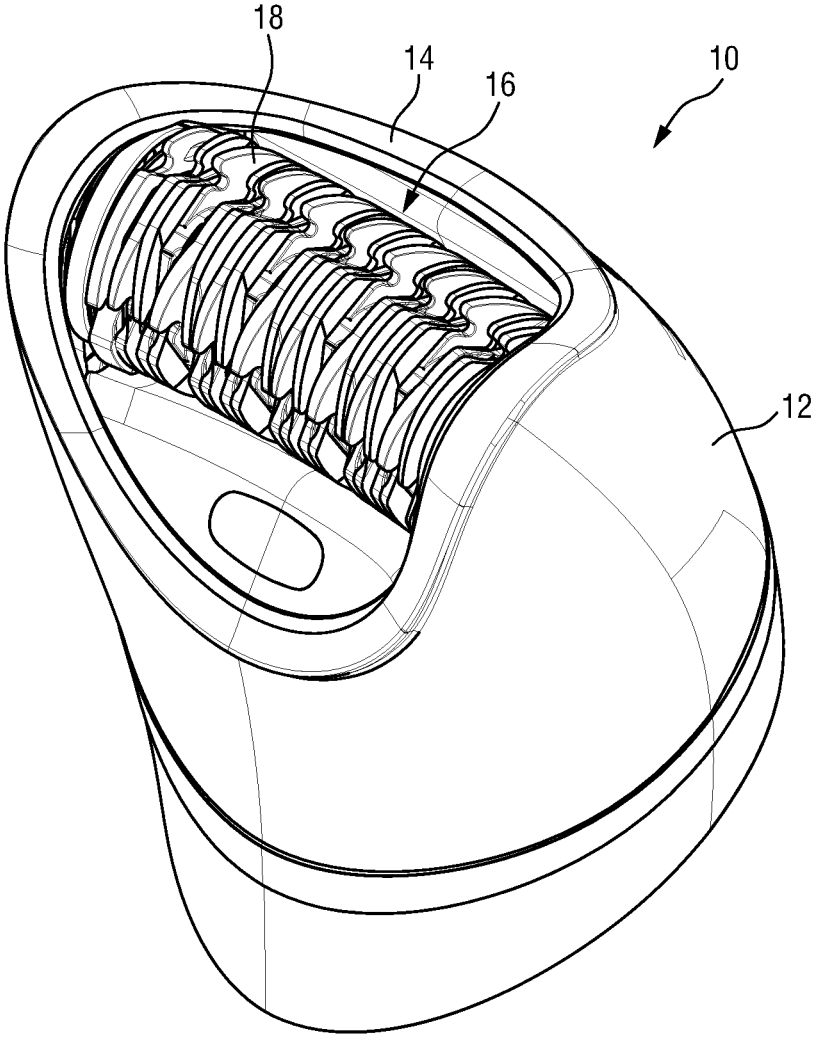
FIG. 1 shows a perspective partial representation of an epilating device according to the invention, wherein only the upper housing part carrying the epilating system is shown.

FIG. 1 shows a partial enlarged perspective representation of an epilating device according to the invention which is designated in total with reference numeral 10.

The epilating device 10 comprises a housing 12, wherein an opening 14 is provided. Within the opening 14 there is provided an epilating system that is designated in total with reference numeral 16. The epilating system 16 comprises a plurality of hair-clamping elements 18 that are arranged adjacent to each other and are commonly rotatable relative to the housing 12.

Figure 2:
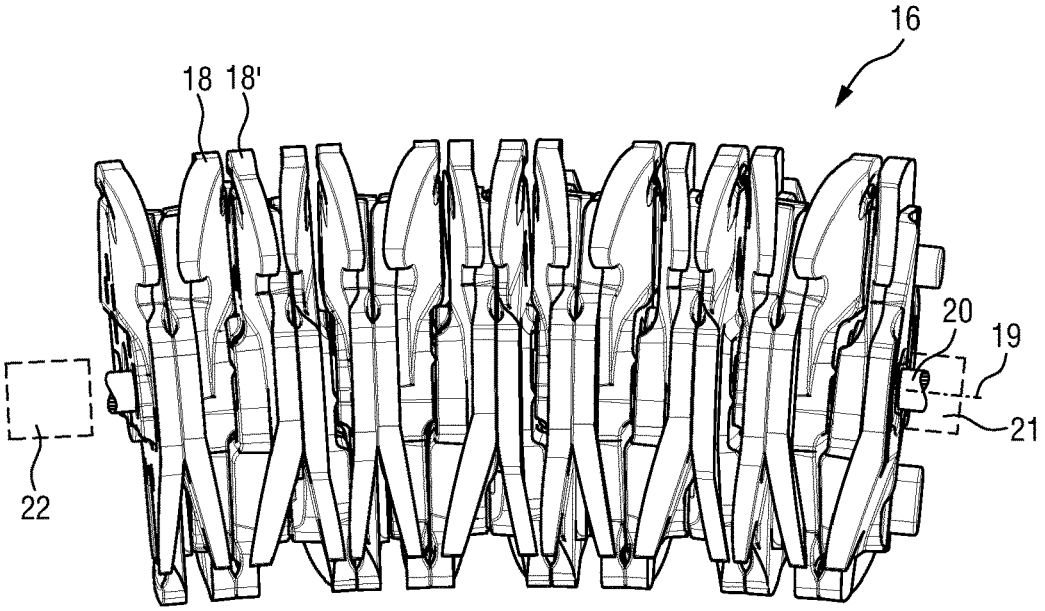
FIG. 2 shows an enlarged representation of the epilating system shown in a side view.

The epilating system 16 is shown in more detail in FIG. 2. The epilating system 16 comprises a plurality of hair-clamping elements that are arranged in pairs 18, 18' and are arranged rotatable about a curved supporting shaft 20. At the right end there is shown a compression member 21 shown only in dashed lines. The compression member 21 exerts a compression force on the epilating system 16 along the compressing line which extends parallel to a main direction of extension of the axis of rotation 19. On the left side there is shown schematically in dashed lines a drive system 22 that engages the first hair-clamping element on the left side for rotating the stack of hair-clamping elements 18, 18' about the curved supporting shaft 20. During rotating the hair-clamping elements 18, 18' are tiltable relative to each other under the influence of the compression force.

The hair-clamping elements 18, 18' each comprise torque transmitting elements 40, 41 (see FIG. 3) and 46, 47 (see FIG. 4) that engage each other for transmitting torque between the adjacent hair-clamping elements 18, 18', when the drive system 22 is activated.

Figure 3:
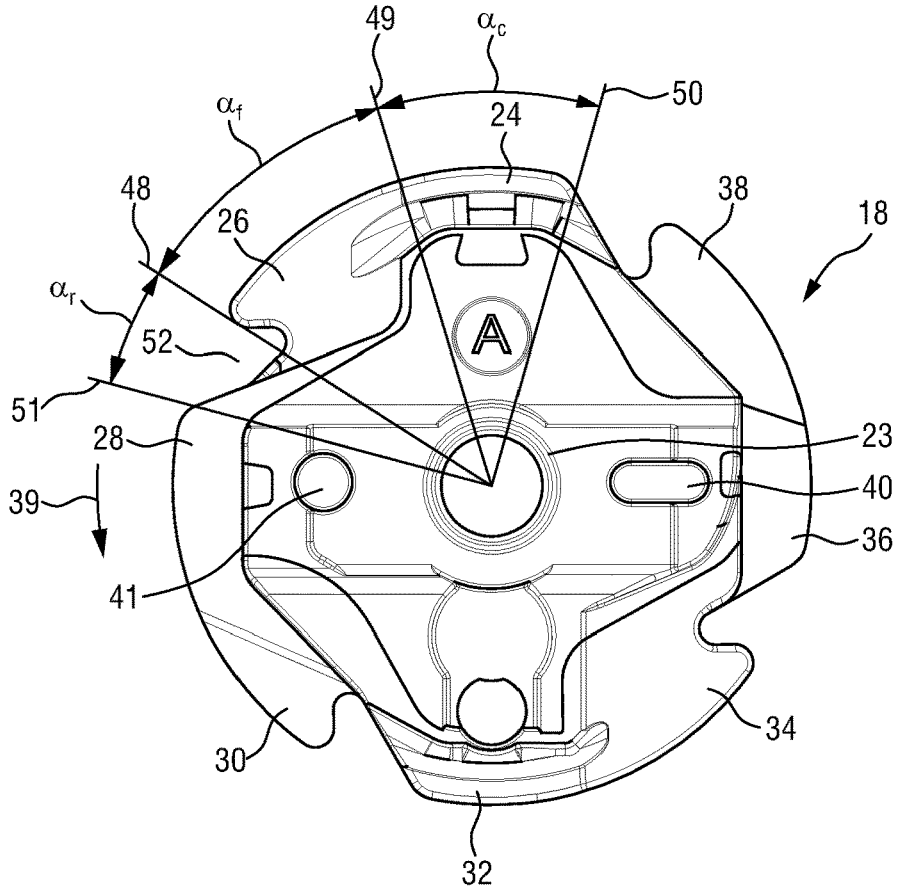
FIG. 3 shows an enlarged side view of a hair-clamping element according to FIG. 2.

The hair-clamping elements 18, 18' are configured in disk-shape and are designed substantially symmetrical as can be seen from FIG. 3 which shows a top view of one of the hair-clamping elements 18 according to the invention.

The hair-clamping element 18 is basically disk-shaped with a central receiving opening 23 through which the curved shaft 20 extends. The hair-clamping element 18 has a symmetrical shape and comprises four lands or tweezers extending from the receiving opening 23 outwardly, all having substantially identical shape, wherein each of which is displaced with respect to the adjacent one by 90° about the center of the receiving opening 23. The hair-clamping element 18 comprises four hair-clamping sections 24, 28, 32, 36 and four hair-catching sections 26, 30, 34, 38 each of which precedes the respective hair-clamping section 24, 28, 32, 36 in the rotational direction 39. Between each hair-clamping section 24, 28, 32, 36 and the adjacent hair-catching section 26, 30, 34, 38 there is a recessed area 52 that extends in the tangential direction 39 and is recessed relative to the hair-clamping section 24, 28, 32, 36 and the adjacent hair-catching section 26, 30, 34, 38.

Figure 4:
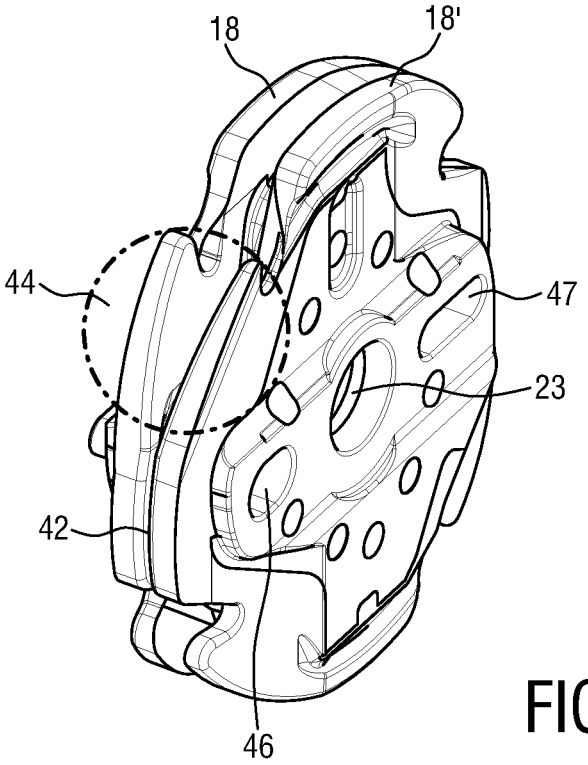
FIG. 4 shows a pair of cooperating hair-clamping elements shown in perspective view from a front side view.
Figure 5:
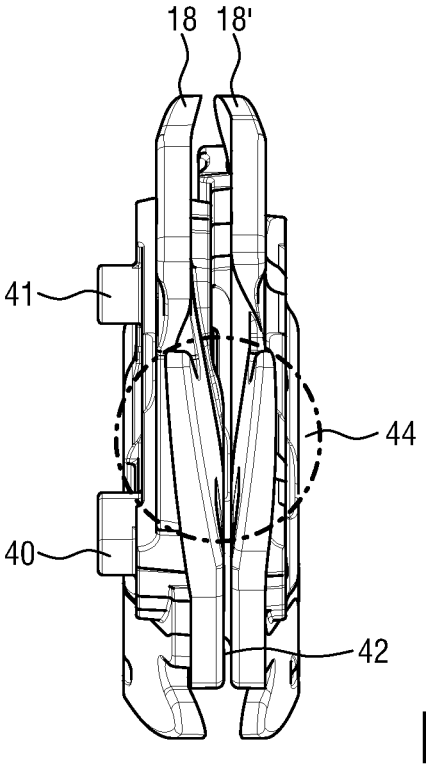
FIG. 5 shows the pair of hair-clamping elements according to FIG. 4 shown in a near front view.

As shown in FIGS. 4 and 5, the hair-catching sections 26, 30, 34, 38 of a pair of adjacent hair-clamping elements 18, 18' define a funnel area 44 designated in FIGS. 4 and 5 by a circle, wherein the hair-catching sections 26, 30, 34, 38 converge towards each other for guiding hairs towards the hair-clamping sections 24, 28, 32, 36 of the pair of adjacent hair-clamping elements. The hair-clamping sections 24, 28, 32, 36 together form a hair-clamping area designated with 42 in FIGS. 4 and 5.

As shown in FIG. 3, each hair-catching section 26, 30, 34, 38 that defines the funnel area 44 extends in a tangential direction between a first radial line 48 and a second radial line 49 defining a funnel angle $\alpha_f$ between the first and second radial lines 48, 49.

Similarly, each hair-clamping section 24, 28, 32, 36 that defines the hair-clamping area 42 extends between the second radial line 49 and a third radial line 50 so as to define a clamping angle $\alpha_c$ that extends between the second radial line 49 and the third radial line 50. Each recess area 52 extends about an angle $\alpha_r$ in tangential direction between the first radial line 48 and a fourth radial line 51. The second and third radial lines 49, 50 are defined by the ends of the slanted area of each hair-clamping element 18, 18' (see FIGS. 4 and 5) that lead to the converging funnel shape. The forth radial line 51 that together with the first radial line 48 defines the recessed area 52, is defined by touching the end of the adjacent hair-catching section 26, 30, 34, 38.

In the embodiment shown in FIG. 3 each hair-clamping element 18, 18' is configured with symmetrical shape comprising four lands, and the sum of the funnel angle $\alpha_f$, of the clamping angle $\alpha_c$, and of the recess angle $\alpha_r$ is: $\alpha_f+\alpha_c+\alpha_r=90°$. It is noted that, in general, said sum might be different from 90°, in particular in embodiments wherein the number of said lands is different from four. In particular embodiments, there may be a non-functional part between two adjacent lands.

While the stack of hair-clamping elements 18, 18' according to FIG. 2 rotates about the curved supporting shaft 20 under the action of the compression force exerted by the compressing number 21 leads to a tilting movement of the hair-clamping elements 18, 18' between an open position, wherein the hair-clamping section 24, 28, 32, 36 of the pair of adjacent hair-clamping elements are at a distance from each other, and a closed position, wherein the hair-clamping section 24, 28, 32, 36 of the pair of adjacent hair-clamping elements 18, 18' are in mutual clamping engagement in a hair-clamping area 42.

Figure 6:
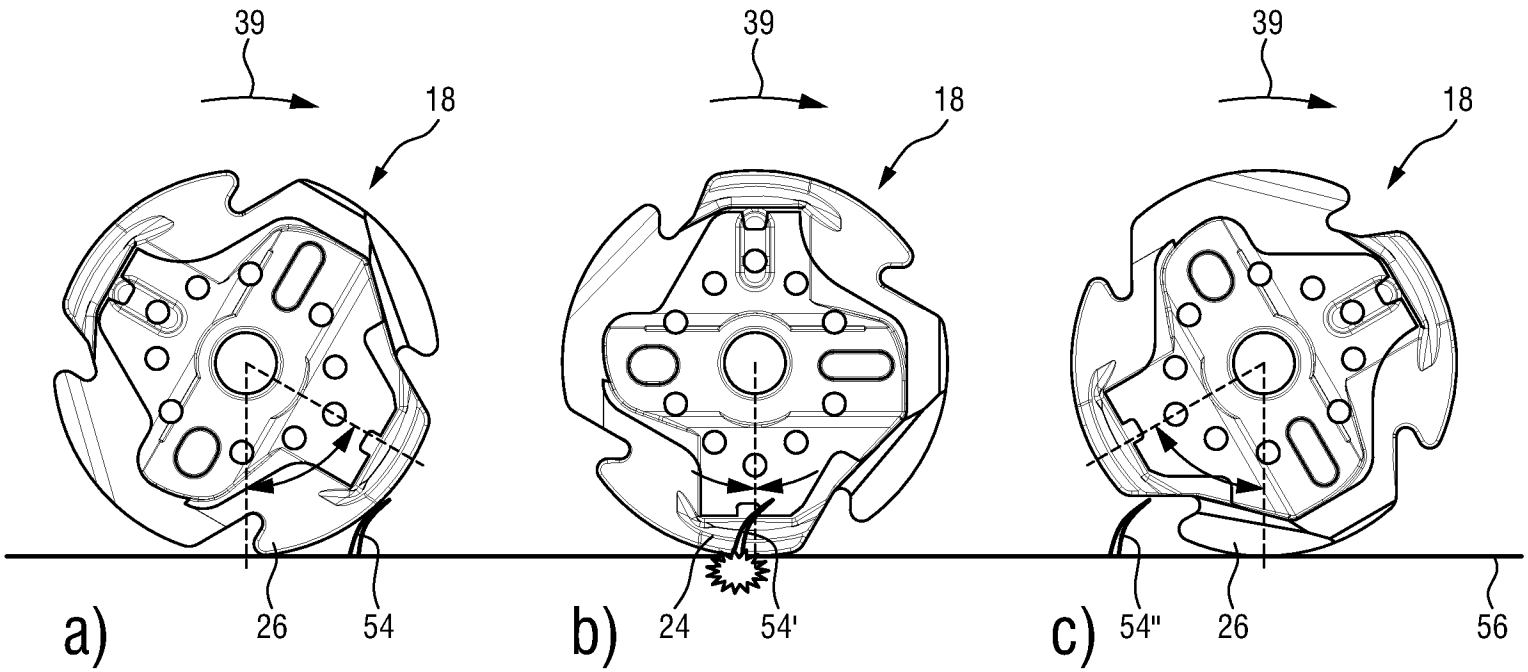
FIG. 6 shows a schematic representation of a hair-clamping element that is guided across a skin surface, shown in different situations depicted in a), b) and c).

It was found that the hair catching and clamping efficacy to a large extend depends on the ratio β which is defined as the ratio $\alpha_c/\alpha_f$ between the clamp angle $\alpha_c$ and the funnel angle $\alpha_f$. This is shown schematically in FIG. 6, wherein a epilating device is guided along a skin surface 56 at different angles.

In FIG. 6*a*), the situation is shown that a hair designated by 54 merely touches the hair-clamping element 18 from the outside so that the hair 54 cannot enter the hair-clamping area 42 to be extracted. So according to the situation 6*a*) there will be no hair extraction.

By contrast in FIG. 6*b*) the situation is shown that a hair 54' that previously entered the recessed area 52 and was drawn into the funnel area 44 finally is within the hair-clamping area 42 so that the hair 54' will be clamped and removed from the skin.

By contrast according to FIG. 6*c*) the hair 54" is engaged too late, since the recessed area 52 was entered too late to be drawn into the funnel area 44 and to be clamped and extracted within the hair-clamping area 42. So also in this case there will be no hair extraction.

It was found that the hair catching and clamping efficacy is considerably increased with respect to the prior art when the ratio β is in a range from 1.65 to 8.75. It was found that in this case the hair catching and clamping efficacy (the chance of clamping a hair once it has been successfully caught by the funnel) is much bigger than in the case when a larger part of the circumference of the hair-clamping element is covered with clamping sections.

While in the prior art according to EP as mentioned at the outset (EP 2 719 300 A2) β is in the range of 1.05 to 1.6, or is 0.68 with the epilating device that was used in public by the applicant, the range β of 1.65 to 8.75 according to the invention leads to a much enhanced hair extracting efficiency.

Instead of using the ratio β, also a ratio γ being defined as the ratio $\alpha_c/(\alpha_f+\alpha_r)$ may be used for describing the design of the clamping angle $\alpha_c$, the funnel angle $\alpha_f$ and the recess angle $\alpha_r$. The ratio β given above corresponds to a ratio $\gamma=\alpha_c/(\alpha_f+\alpha_r)$ being in a range of 1.26 to 3.5.

Preferred ranges for β are a minimum of 1.75 and a maximum of 8 or 7. A more preferred range for β is 1.75 to 7. The most preferred value for β is 1.79.

Each hair-clamping element 18, 18' comprises a first and a second set of a hair-clamping area 42 and a preceding funnel area 44 arranged in diametrically opposite positions on a first side surface facing one of the two adjacent hair-clamping elements 18, 18', and a third and a fourth set of a hair-clamping area 42 and a preceding funnel area 44 arranged in diametrically opposite positions on a second side surface facing the other one of the two adjacent hair-clamping elements 18, 18', wherein the first and second sets are arranged relative to the third and fourth sets with angular intervals of 90° relative to the axis of rotation.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. An epilating device for extracting hairs out of a user's skin, comprising:

a housing;

an epilating system comprising a plurality of hair-clamping elements arranged adjacent to each other and rotatable relative to the housing about an axis of rotation; and a drive system arranged to rotate the hair-clamping elements in a rotational direction about the axis of rotation;

wherein:

the hair-clamping elements are arranged to co-operate in pairs and are moveable relative to each other by means of an actuation mechanism during rotation of the epilating system;

each hair-clamping element comprises, on each side surface facing an adjacent hair-clamping element, at least one hair-clamping section and at least one hair-catching section preceding the hair-clamping section in the rotational direction;

the hair-catching sections of a pair of adjacent hair-clamping elements define a funnel area, wherein the hair-catching sections converge towards each other for guiding hairs towards the hair-clamping sections of the pair of adjacent hair-clamping elements;

the hair-clamping sections of the pair of adjacent hair-clamping elements are movable relative to each other from an open position, where the hair-clamping sections of the pair of adjacent hair-clamping elements are at a distance from each other, to a closed position, where the hair-clamping sections of the pair of adjacent hair-clamping elements are in mutual clamping engagement in a hair-clamping area;

seen relative to the axis of rotation, the funnel area extends in a tangential direction between a first radial line and a second radial line, and wherein a funnel angle ($\alpha_f$) of the funnel area is defined as the angle enclosed by the first and second radial lines; and seen relative to the axis of rotation, the hair-clamping area extends in a tangential direction between the second radial line and a third radial line, and wherein a clamping angle ($\alpha_c$) of the hair-clamping area is defined as the angle enclosed by the second and third radial lines;

a ratio ($\beta$) being defined as the ratio ($\alpha_c/\alpha_f$) between the clamping angle ($\alpha_c$) and the funnel angle ($\alpha_f$), is in a range from 1.65 to 8.75, the each hair-clamping element comprises at least one recessed area which precedes the hair-catching section in the rotational direction and is recessed relative to the hair-clamping section and the hair-catching section in a radial direction relative to the axis of rotation;

seen relative to the axis of rotation, the recessed area extends in a tangential direction between the first radial line and a fourth radial line, wherein a recess angle ($\alpha_r$) of the recessed area is defined as the angle enclosed by the first and fourth radial lines; and a ratio ($\gamma$) being defined as the ratio ($\alpha_c/(\alpha_f+\alpha_r)$) between the clamping angle ($\alpha_c$) and the sum of the funnel angle ($\alpha_f$) and the recess angle ($\alpha_r$) is in a range from 1.26 to 3.5.

2. The epilating device as claimed in claim 1, wherein the ratio ($\beta$) is at least 1.75.

3. The epilating device as claimed in claim 1, wherein the ratio ($\beta$) is not larger than 8.

4. The epilating device as claimed in claim 1, wherein the ratio ($\beta$) is not larger than 7.

5. The epilating device as claimed in any claim 1, wherein the actuation mechanism comprises a compression member arranged to exert a compression force on the epilating system along at least a compression line which extends parallel to a main direction of extension of the axis of rotation, wherein the hair-clamping elements are tiltable relative to each other under the influence of the compression force during rotation of the epilating system.

6. The epilating device as claimed in claim 1, wherein the each hair-clamping elements is each configured in disk-shape and comprises two pairs of a hair-clamping area and a preceding funnel area on each side surface facing an adjacent hair-clamping element.

7. The epilating device as claimed in claim 6, wherein the each hair-clamping element, which is arranged between two adjacent hair-clamping elements, comprises a first and a second set of a hair-clamping area and the preceding funnel area arranged in diametrically opposite positions on a first side surface facing one of the two adjacent hair-clamping elements, and a third and a fourth set of a hair-clamping area and the preceding funnel area arranged in diametrically opposite positions on a second side surface facing the other one of the two adjacent hair-clamping elements, wherein the first and second sets are arranged relative to the third and fourth sets with angular intervals of 90° relative to the axis of rotation.

8. The epilating device as claimed in claim 1, wherein the pairs of adjacent hair-clamping elements each comprise torque-transmitting elements engaging each other for transmitting torque between the adjacent hair-clamping elements.

9. The epilating device as claimed in claim 1, wherein the hair-clamping elements are rotatably supported by a curved supporting shaft mounted in a stationary position relative to the housing, wherein the hair-clamping elements each comprise a receiving opening arranged centrally on the hair-clamping element for receiving the supporting shaft.

* * * * *